US005540522A

United States Patent [19]

Launaro et al.

[11] Patent Number: 5,540,522

[45] Date of Patent: Jul. 30, 1996

[54] SEISMIC JOINT FOR UNDERWATER FLOATING TUNNELS

[75] Inventors: Fabio Launaro, Fano; Roberto Bruschi, Falconara Marittima; Floriano Casola, Gazzada Schianno, all of Italy; Robert Warshaw, East Meadow, N.Y.

[73] Assignees: Eniricerche S.p.A.; Snamprogetti S.p.A., both of Milan; Enisud S.p.A., Rome; Saipem S.p.A.; Snam S.p.A, both of Milan; Tecnomare S.p.A., Venezia, all of Italy; Parson Brinckeroff Quade & Douglas, Inc., New York, N.Y.

[21] Appl. No.: 131,901

[22] Filed: Oct. 5, 1993

[30] Foreign Application Priority Data

Jul. 9, 1993 [IT] Italy ..... MI93A1487

[51] Int. Cl.[6] ..... E21D 10/08

[52] U.S. Cl. ..... 405/136; 52/167.1; 405/132; 405/135

[58] Field of Search ..... 405/136, 134, 405/135, 132; 52/167.1–167.9

[56] References Cited

U.S. PATENT DOCUMENTS

| | | | |
|---|---|---|---|
| 723,986 | 3/1903 | Carson | 405/136 |
| 2,055,000 | 9/1936 | Bacigalupo | 52/167.6 |
| 3,517,515 | 6/1970 | Warshaw | 405/135 |
| 4,444,526 | 4/1984 | Foundoukos et al. | 405/136 |
| 4,766,706 | 8/1988 | Caspe | 52/167.9 X |
| 4,860,507 | 8/1989 | Garza-Tamez | 52/167.4 |

*Primary Examiner*—Dennis L. Taylor

*Attorney, Agent, or Firm*—George P. Hoare, Jr.; Rogers & Wells

[57] ABSTRACT

This invention provides a seismic joint for an underwater floating tunnel having: (a) a joint portion (i) having a transverse section essentially the same as that of the tunnel, (ii) being rigidly fastened to land at one end (A) thereof, and (iii) being elastically constrained to the tunnel at its other end (B) via a plurality of operably affixed means which performs an elastic function and a damping function; (b) a collar welded onto the external surface of the tunnel facing end (B) of the portion, said collar being capable of sliding on and along the external surface of the joint portion; and (c) a means for providing a water-tight seal between the internal surface of the collar and the external surface of the joint portion.

7 Claims, 4 Drawing Sheets

SEISMIC JOINT FOR UNDERWATER FLOATING TUNNELS

FIELD OF THE INVENTION

The present invention relates to a seismic joint for underwater floating tunnels.

More particularly, the present invention relates to a seismic joint for the ends of underwater floating tunnels, capable of axially constraining the tunnel both during the normal operations of the structure, during which said tunnel undergoes the action of axial forces normally different from zero, due to water streams and waves combined with the effects of thermal expansion/contraction, and during a seismic event.

BACKGROUND OF THE INVENTION

The connection between adjacent Land regions separated by water has always being overcome by building either suspended or laid bridges, which have secured the continuity of transport either by railways or motorways.

However, when the width of water stretch reaches high values or when, owing to the nature of water body floors or environmental conditions, the construction of bridges is not technically feasible. The transport of both goods and people is performed by naval or air means, with obviously higher costs and drawbacks essentially due to the long times required for boarding and landing.

Now, the need for rendering faster and cheaper, transport together with technological development, has led to the development of new connection systems, represented by underground or underwater tunnels. Typical examples are the underground tunnel excavated under The Channel, or the underwater tunnel for the metropolitan railway, submerged and laid on the sea bed of San Francisco Bay in California.

The underwater tunnels, generally constituted by a plurality of modules assembled with one another, can be laid on a water bodies' floor and anchored to it, or they can be floating inside water and anchored to the sea bed by means of tensioned elements in order to counteract their buoyancy. In both cases, the tunnels are subject to external forces which are constant in time (for example the forces due to the action of marine streams), or forces of periodical or random character (such as those which are due to heat contraction/expansion caused by temperature changes), or those due to the action of a seismic event.

Whilst for underwater tunnels laid on a water body's bed the stresses due to the external forces do not constitute a problem, because the action of such forces generally is compensated for by the friction forces due to the supporting bed. In the case of floating underwater tunnels, suitable devices interposed between their ends and the land are necessary, which ensure that the whole structure will withstand the stresses caused by the above mentioned forces and make possible the absorption of displacement, in particular the axial displacements, which generally are larger than those met in the case of laid tunnels. All the above is essential in order to prevent the structure from undergoing undesired displacements.

Furthermore, it is necessary that during a seismic event, the connection joints with the land can move freely in order to avoid the ends of the tunnel being affected by axial forces, which would otherwise are impossible to withstand. Under such conditions, the axial constraint between each tunnel end and the land must be equivalent to a spring and damper installed in parallel ("damped spring").

DETAILED DESCRIPTION OF THE INVENTION

The present Applicants have now found a novel joint suited to connect underwater floating tunnels to the land, which are capable of compensating for considerably Large displacements of the underwater structure due to different causes. Such causes include contraction/expansion caused by temperature changes, the action of streams, and the action of a seismic event.

Therefore, the subject matter of the present invention is a seismic joint for underwater floating tunnels comprising:

(a) a portion, having a transversal section which is essentially the same as the one of the tunnel, said portion is capable of being rigidly fastened to the land, at one end (A) thereof, and of being elastically constrained to the tunnel, at its other end (B);

(b) a plurality of means capable of performing an elastic effect and a damping effect, interposed between the end (B) of the portion of the joint and the tunnel;

(c) collar welded onto the external surface of the tunnel end facing the end (B) of the portion and capable of sliding on and along the external surface of said joint portion;

(d) means for providing a water tight seal between the internal surface of the collar and the external surface of said joint portion.

The joint portion is preferably a structure of a cylindrical shape. Different shapes, e.g. of parallelepiped can type, also be used.

Inasmuch as the underwater tunnels are constructed with such a size as to be capable of housing a motorway with at least two lanes, or a double-track railway, the internal diameter of the portion section is generally longer than 10 meters, and normally is within the range of from 12 to 18 meters, The damping/elastic effect is obtained by means of a plurality of oil-dynamic cylinders, peripherally arranged and having axes parallel to the axis of the tunnel, the number of which depends on the size of the whole structure. Generally, the number of such cylinders is preferably within 18 and 25.

Each cylinder is connected with an oil-pneumatic accumulator by means of a hydraulic circuit which essentially comprises, per each cylinder fitting, a pressure relief valve and a direction control valve ("check valve") arranged in parallel to each other.

In those cases when, in the event of a seism, very large axial shifts have to be absorbed, for example of up to 150 cm, the ram stroke is of approximately 300 cm and the bore diameter of the cylinder is of approximately 50–80 cm.

The oil-pneumatic accumulator is a vessel which, under static tunnel equilibrium conditions, is half-filled with oil from the oil-pneumatic circuit, with the other half thereof being filled with a gas, generally nitrogen, under a pressure of about 50–80 bars.

The collar welded onto the external surface of the tunnel end facing the end (B)z can slide and slip along the external surface of the portion, with a stroke length equal to the maximal length of expected tunnel displacements and compensated for by the joint according to the present invention. In order to favour said sliding/slipping, that part of the joint portion which is in contact with said collar is coated with a self-Lubricating material, for example with TEFLON®.

According to an alternative embodiment, the collar can be welded onto the external surface of said joint portion, near the end (B), and can slide and slip along the external surface of the tunnel.

In order to prevent any water seepage, the joint is furthermore provided with a means for providing a water tight seal interposed between the internal collar surface and the external surface of the portion. These tight seal means include, for instance, either natural or synthetic rubber bands fastened onto the internal collar surface.

BRIEF DESCRIPTION OF THE DRAWINGS

The structural and functional features of the seismic joint for underwater tunnels according to the present invention will be better understood by referring to the drawings of the accompanying figures, which depict an illustrative, non-limitative embodiment thereof, and in which.

DESCRIPTION OF THE PREFERRED EMBODIMENTS

Figure 1:
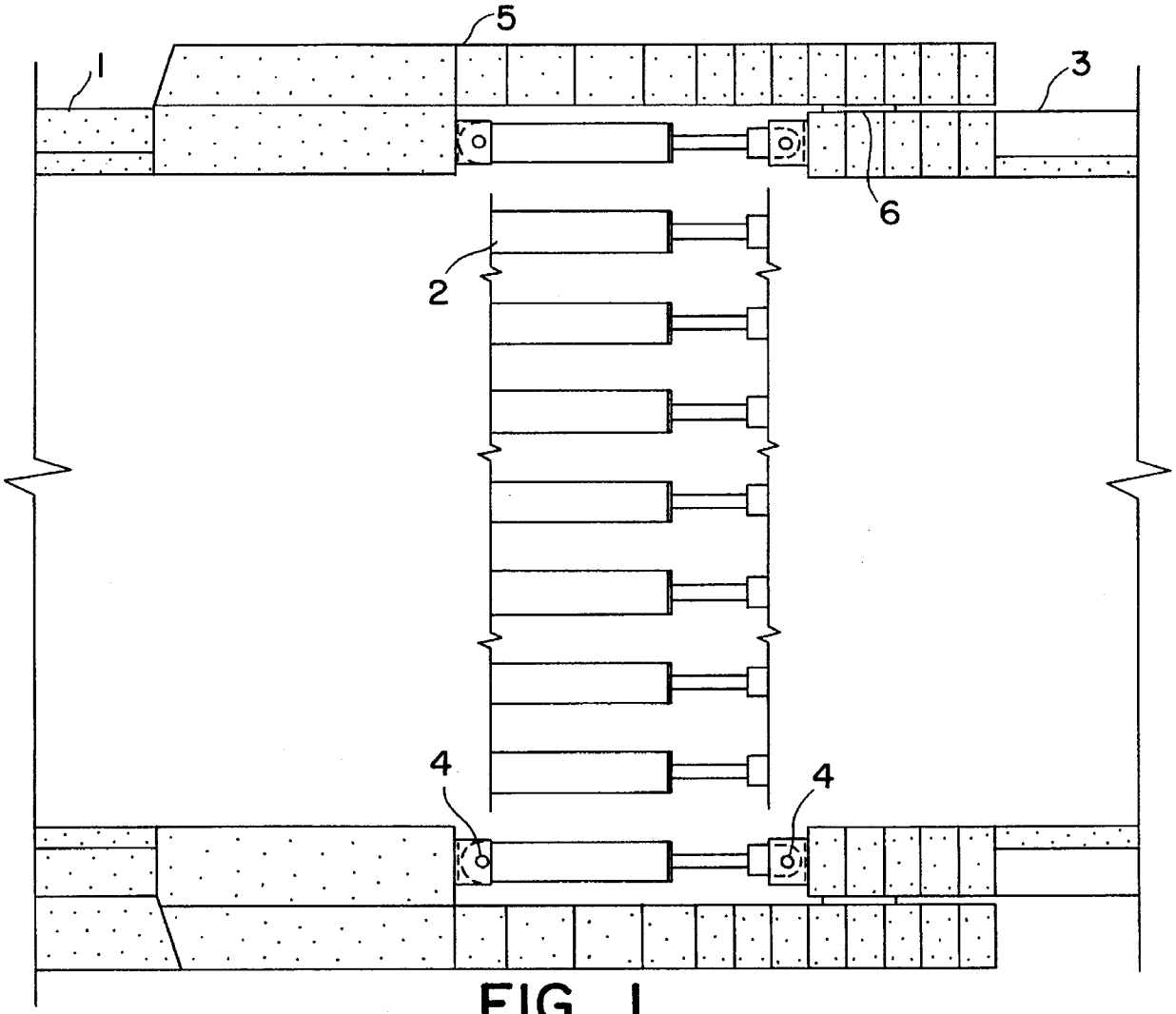
FIG. 1 displays a schematic view of a cross section of the joint assembled with the tunnel.

Referring to the Figures, the seismic joint according to the present invention comprises a portion (1), a plurality of elastic/damping elements (2) fastened onto the portion (1) and to the tunnel module (3) by means of hinges (4), the collar (5) and the tight sealing gaskets (6).

The elastic/damping element, in turn, comprises the cylinder (10), inside which the ram (11) slides which is fastened to the stem (12), the accumulator (13) and the hydraulic circuits which connect said accumulator with the rear chamber (14) and the front chamber (15) of the cylinder. In each of both hydraulic circuits two valves are installed, and, namely, a pressure relief valve (16) or (16') and a direction control valve (17) or (17'), each constituted by a cartridge valve, the opening of which is piloted by the valves (18) or (18').

The operating modality of the joint will be evident from the preceding disclosure and from an analysis of the accompanying drawings.

During the normal operating mode, the joint compensates for the external forces, keeping the tunnel in its axial position, while simultaneously allowing it to expand/contract owing to the effect of temperature changes.

The valves (16) and (16') are set at opening values which are equal to (at bank X) and higher than (at the other bank Y) the maximal pressure values which arise inside the cylinder chambers owing to the effect of the external forces with, an axial fixed constraint being obtained at bank Y and a sliding one at bank X.

Supposing now that to the external forces a heat expansion of the tunnel adds up, which would tend to cause the stem (12) to move inwards, the pressure inside the chamber (14) will increase up to the valve (16) opening value, whilst the valves (17) and (19) remain closed. In that way, the tunnel can continue to expand, with oil being transferred from the cylinder to the accumulator (13) and, from the latter, to the other cylinder chamber through the check valve (19').

Figure 2:
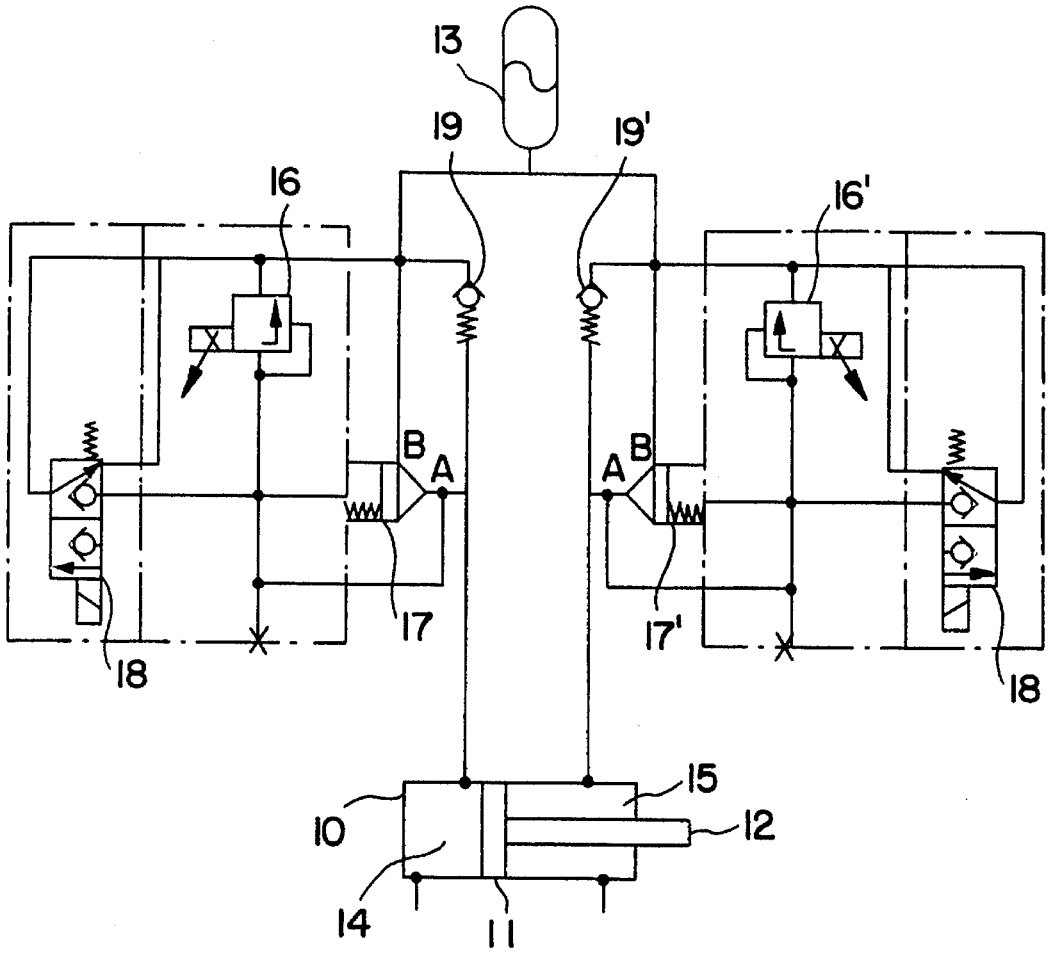
FIG. 2, together with its versions 2*a* and 2*b*, schematically display a hydraulic circuit by means of which an elastic effect and a damping effect can be realized.
Figure 2A:
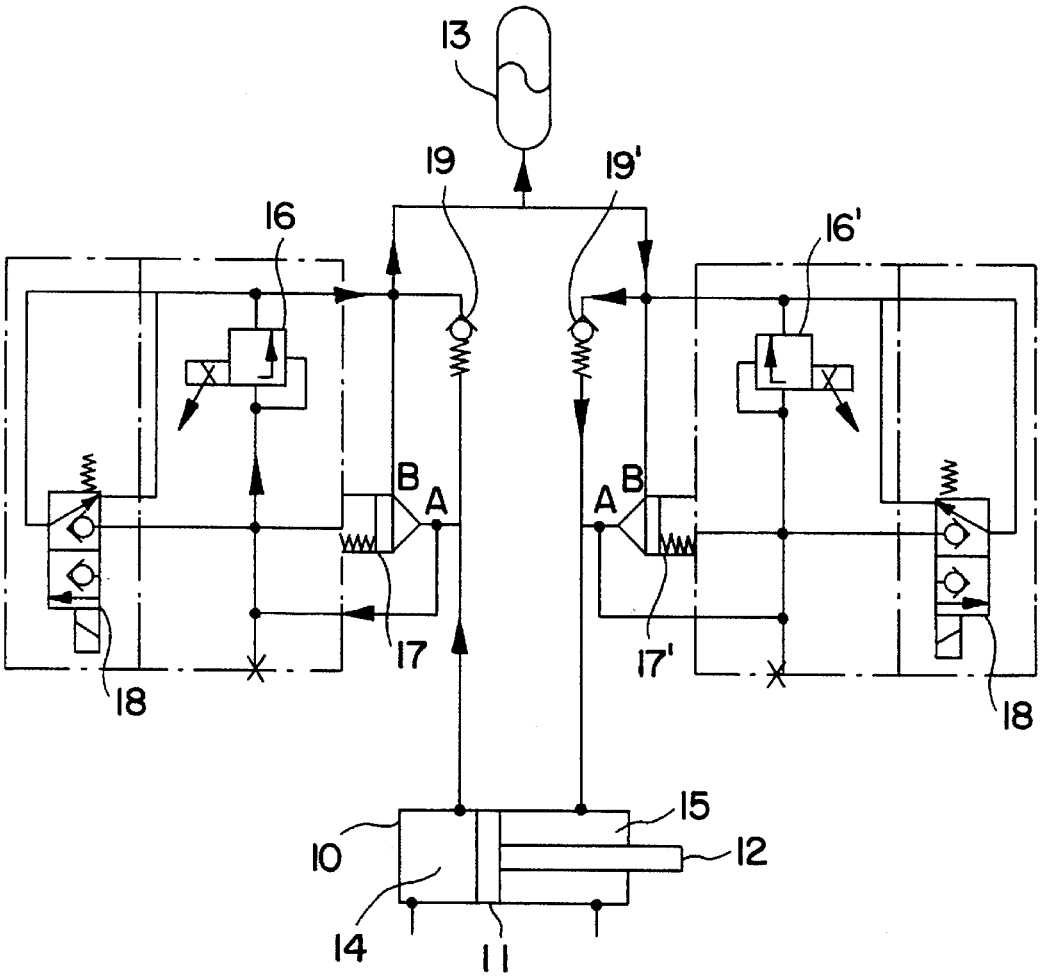

The oil path is displayed in bold lines in FIG. 2*a*.

During a seismic event, suitable means, not displayed in the Figure (for example, an accelerometer) cause the valves (18) or (18') to switch and open the openings of valves (17) or (17').

In this configuration, the cylinders may freely expand or contract, allowing the tunnel to oscillate. More particularly, during tunnel oscillation, the cylinders installed on the joint at one bank undergo an elongation, and those installed on the joint at the other bank undergo a retraction.

When the cylinder (10) undergoes a retraction, the oil amount which leaves the rear chamber (14) is, owing to the difference in surface areas, larger than the amount which enters the front chamber (15). The excess amount of oil is hence absorbed by the accumulator (13), the pressure inside of which tends to increase owing to the decrease in available volume for nitrogen. Therefore, the accumulator (13) behaves as a gas spring, the stiffness of which varies with varying cylinder position along its stroke.

When the cylinder (10) is undergoing an elongation, the event develops in the reverse way, with the internal accumulator pressure decreasing.

The damping effect is obtained, on the contrary, by taking advantage of the oil pressure drop which takes place during the passage through the openings of valves (17) and (17').

When the cylinder (10) is undergoing a retraction, the pressure drop through the valve (17) creates a back pressure inside the rear chamber, relative to the pressure which is being established inside the accumulator (13), whilst the pressure drop through the other valve (17') creates a depressurization inside the front chamber. The net effect of these actions is a force, opposite to stem (12) movement. Each cylinder behaves hence as a damper, the damping coefficient of which essentially depends on the size of the valves (17) and (17') and on the speed of stem (12). For those cylinders which are undergoing an elongation, the phenomenon is analogous.

Figure 2B:
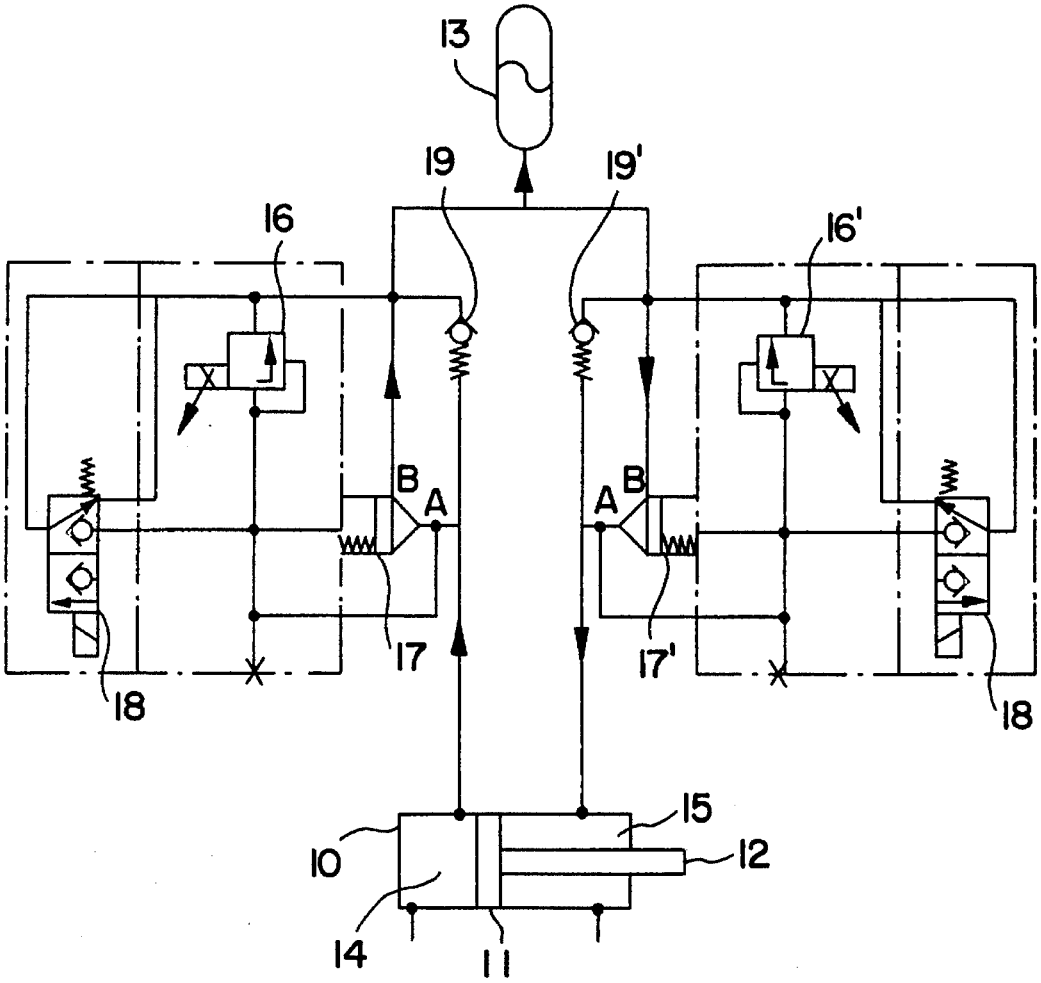

The oil path, for those cylinders which are undergoing a retraction, during the seismic event, is illustrated in bold lines in FIG. 2*b*.

Even if the joint of the present invention has been described mainly for the connection of floating tunnels to the land, it can be used, if necessary, also for the connection to the land of tunnels laid on the seabottom.

We claim:

1. A seismic joint for an underwater floating tunnel which comprises:

(a) a joint portion (i) having a transverse section essentially the same as that of the tunnel, (ii) capable of being rigidly fastened to land at one end (A) thereof, and (iii) being elastically constrained to the tunnel at its other end (B) via a plurality of operably affixed means which perform an elastic function and a damping function;

(b) a collar welded onto the external surface of the tunnel facing end (B) of the portion, said collar being capable of sliding on and along the external surface of the joint portion; and (c) a means for providing a water-tight seal between the internal surface of the collar and the external surface of the joint portion.

2. The joint of claim 1, wherein the plurality of means which perform an elastic function and a damping function comprise a plurality of oil-pneumatic cylinders, peripherally arranged and having axes parallel to the axis of the tunnel.

3. The joint of claim 2, wherein each cylinder is connected with an oil-pneumatic accumulator by means of a hydraulic circuit which essentially comprises, per each cylinder fitting, a pressure relief valve and a direction control valve arranged in parallel to each other.

4. The joint of claim 1, wherein the collar can slide and slip with a stroke length equal to the maximal length of an expected tunnel shift.

5. The joint of claim 1, wherein the means for providing a water-tight seal comprises bands fastened onto the internal collar surface.

6. The joint of claim 5, wherein the bands are made of natural or synthetic rubber.

7. A seismic joint for an underwater floating tunnel which comprises:

(a) a joint portion (i) having a transverse section essentially the same as that of the tunnel, (ii) being rigidly fastened to land at one end (A) thereof, and (iii) being elastically constrained to the tunnel at its other end (B) via a plurality of operably affixed means which perform an elastic function and a damping function; and (b) a collar welded onto the external surface of the joint portion near end (B), said collar being capable of sliding on and along the external surface of the tunnel.

* * * * *